US011598110B2

(12) United States Patent
Elliott, Jr.

(10) Patent No.: US 11,598,110 B2
(45) **Date of Patent: *Mar. 7, 2023**

(54) TIERED POOL SYSTEM

(71) Applicant: THE DIVEHEART FOUNDATION, Downers Grove, IL (US)

(72) Inventor: Jimmy Ray Elliott, Jr., Downers Grove, IL (US)

(73) Assignee: The Diveheart Foundation, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/107,351

(22) Filed: Nov. 30, 2020

(65) Prior Publication Data

US 2021/0079677 A1 Mar. 18, 2021

Related U.S. Application Data

(63) Continuation of application No. 15/902,414, filed on Feb. 22, 2018, now Pat. No. 10,851,556.

(60) Provisional application No. 62/463,391, filed on Feb. 24, 2017.

(51) Int. Cl.

| | |
|---|---|
| ***E04H 4/14*** | (2006.01) |
| ***E04H 4/08*** | (2006.01) |
| ***A63B 69/12*** | (2006.01) |

(52) U.S. Cl.
CPC ..... *E04H 4/145* (2013.01); *A63B 69/12* (2013.01); *E04H 4/082* (2013.01)

(58) Field of Classification Search
CPC ..... E04H 4/145; E04H 4/082; A63B 69/12
USPC ..... 4/505, 513
See application file for complete search history.

(56) References Cited

U.S. PATENT DOCUMENTS

| | | | | |
|---|---|---|---|---|
| 2,803,835 | A | 8/1957 | Summers | |
| 3,026,538 | A * | 3/1962 | Boyd | E04H 4/0012 4/487 |
| 4,905,326 | A | 3/1990 | Nakamura et al. | |
| 4,910,814 | A | 3/1990 | Weiner | |
| 5,832,547 | A | 11/1998 | Burroughs | |
| 8,261,378 | B2 * | 9/2012 | Kanetis | E04H 4/084 4/500 |
| 10,851,556 | B2 * | 12/2020 | Elliott, Jr. | E04H 4/082 |
| 2009/0185455 | A1 | 7/2009 | Medina-Brodsky et al. | |
| 2014/0026312 | A1 | 1/2014 | Lignini | |
| 2018/0245364 | A1 | 8/2018 | Elliott, Jr. | |

FOREIGN PATENT DOCUMENTS

| | | | | |
|---|---|---|---|---|
| TW | M544547 U * | 7/2017 | | E04H 4/00 |

* cited by examiner

*Primary Examiner* — Tuan N Nguyen
(74) *Attorney, Agent, or Firm* — Banner & Witcoff Ltd.

(57) ABSTRACT

A diving pool includes a first tiered section extending to a first depth of the diving pool, a second tiered section extending to a second depth of the diving pool that is deeper than the first depth, and a cover. The cover can be releasably positioned within the diving pool at a depth of the diving pool to isolate a shallower portion of the diving pool above the cover at the depth from a deeper portion of the diving pool below the cover at the depth.

19 Claims, 9 Drawing Sheets

TIERED POOL SYSTEM

CROSS REFERENCE TO RELATED APPLICATIONS

This patent application is a continuation patent application of U.S. application Ser. No. 15/902,414, filed Feb. 22, 2018, and titled "Tiered Pool System," now U.S. Pat. No. 10,851,556, which claims priority to U.S. Provisional Patent Application No. 62/463,391, filed Feb. 24, 2017, titled "Tiered Pool System," each of which is incorporated herein by reference in its entirety.

BACKGROUND

Embodiments described herein generally relate to a tiered pool system, and more particularly to a tiered pool system that includes one or more depth-segmented pool sections.

The therapeutic benefits of water have long been known. Ancient Egyptian, Persian, Greek, and Roman civilizations had recognized various forms of hydrotherapy. Hippocrates is known to have prescribed bathing in spring water for sickness. More recently, submerging all or part of the body in water has been identified to stimulate blood circulation, to treat symptoms of certain diseases, and even to relieve pain.

The pressure under water doubles at a depth of 33 feet. Thus, at a depth of 33 feet, the pressure is 2 atmospheres and increases by one atmosphere for each additional 33 feet in depth. The maximum typical depth for recreational scuba is 130 feet (e.g., approximately 5 atmospheres). It known that at 2 atmospheres (i.e., 66 feet in depth) the human body begins to release an extra amount of serotonin, which is a neurotransmitter that, among other functions, mediates one's general mood and wellbeing. Underwater therapy can be used for various medical conditions, with different depths and corresponding pressures being selected based on the medical diagnosis. For example, pressure is a form of therapy for children with autism, individuals with downs syndrome may alleviate their respiratory problems from the deep breathing under pressure when diving, and individuals with chronic spinal cord pain may benefit from the physical properties of water, such as temperature and pressure.

Examples of the benefits that underwater therapy provides are extensive. But, what are equally intriguing are the potential benefits that are still unknown. In this regard, an underwater research lab could provide an environment to learn more about the benefits of the physical properties of water.

Although diving pools presently exist, they may not be safe and/or convenient environments for individuals with ailments. Further, most under water facilities are not conducive for performing research. Accordingly, it would be beneficial to have a safe and controlled environment with adjustable maximum depths that allows individuals to receive therapy and/or perform research under water. It would also be beneficial to have a safe and controlled underwater training facility with adjustable maximum depths.

BRIEF DESCRIPTION OF THE DRAWINGS

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

The exemplary embodiments of the present disclosure will be described with reference to the accompanying drawings.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

The various examples discussed below relate to a man-made diving facility (i.e., Aquatic Center), and more particularly, to a reconfigurable diving pool. The pool can include a first section that is above ground level and a second section that is below ground. In some aspects, both the first and second sections are below ground or above ground. The first section may be made of see-through material, such as glass and/or acrylic. The second section may be made of non-see through material. The second section of the diving pool is tiered and becomes progressively deeper toward the center of the pool. The second section becomes deeper stepwise from one tier to the next from a periphery of the pool toward the center of the pool. The depth of the pool is reconfigurable in that each tier can be enclosed (e.g., by a tier cover) with respect to the tier(s) below. That is, the pool can be configured for different maximum depths based on the current program or activity that is utilizing the pool. For example, the maximum depth can be set based on the treatment program currently associated with the pool, or the depth necessary for the current activity taking place in the pool. The maximum depth can also be set for safety purposes.

Figure 1:
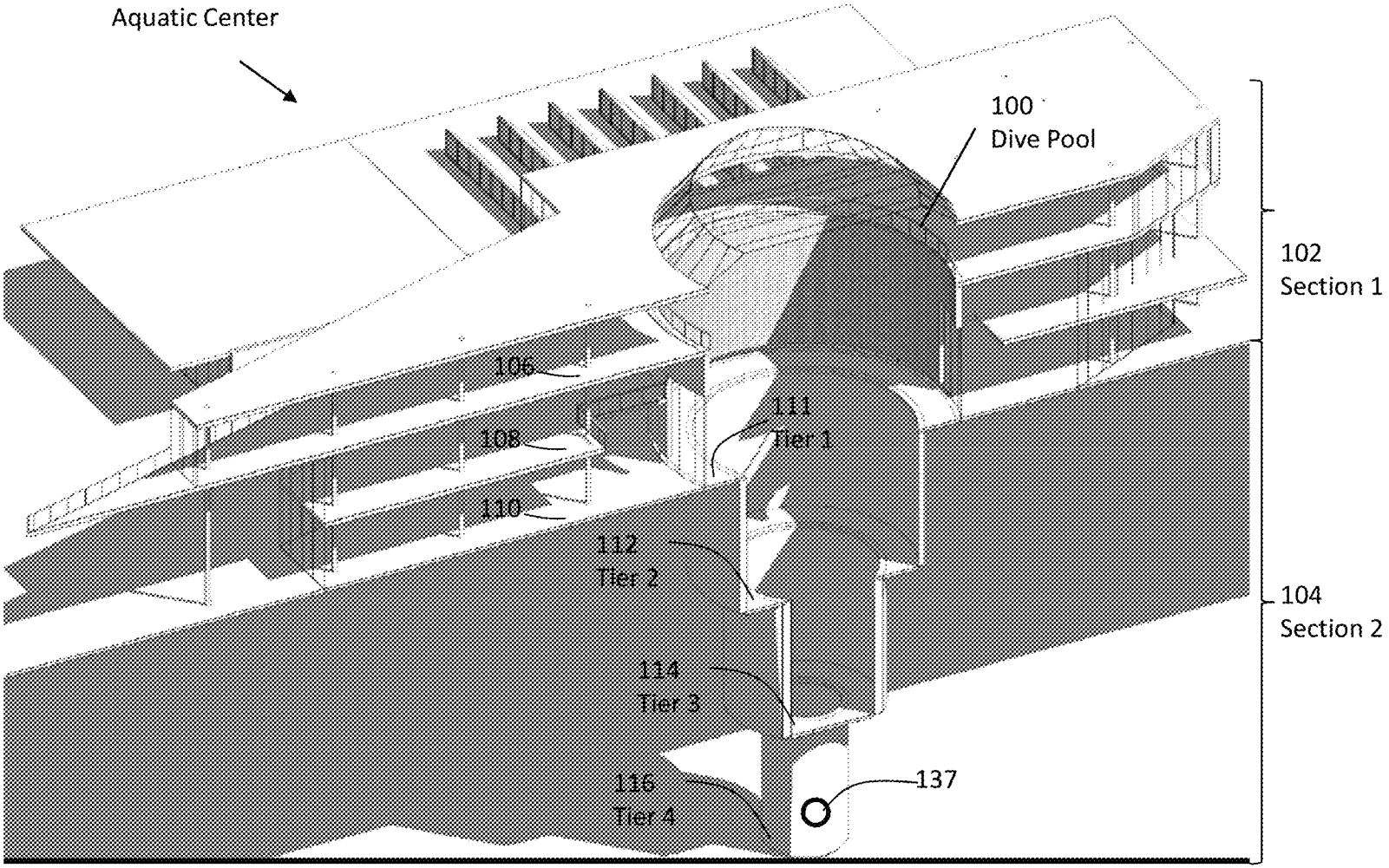
FIG. 1 illustrates a perspective view of an exemplary aquatic center that includes a diving pool according to an exemplary embodiment of the present disclosure.

Reference now is made in detail to the examples illustrated in the accompanying drawings and discussed below. FIG. 1 illustrates an exemplary aquatic center that includes a reconfigurable diving pool 100, consistent with an exemplary embodiment. The diving pool includes a first section 102 that is above ground and a second section 104 that is below ground platform 106. The sections 102 and 104 are not limited to this configuration and both sections 102 and 104 can be above ground level, or both sections 102 and 104 can be below ground level. The first section 102 can include platforms 106, 108, and 110. The top platform 107 can be above the water level while platforms 106 and 108 are below the water level. A tier 111 can be formed at the boundary between the first section 102 and the second section 104. The second section 104 can including a plurality of tiers, including the first tier 111, a second tier 112, a third tier 114, a fourth tier 116, and a fifth tier (not shown in FIG. 1 but shown in FIGS. 2-4.). The tiers of the second section 104 are configured to become progressively deeper toward the center of the pool as the number of the tier increases. For example, tiers 1-5 can have depths of, for example (but not limited to), 33 feet, 66 feet, 99 feet, 130 feet, and 150 feet, respectively.

The first section 102 may comprise see-through material (e.g., transparent material), such as glass and/or acrylic. When viewed from the top, the first section 102 of the diving pool may be circular or may comprise of a plurality of flat panes (e.g., have an octagonal shape). In this regard, each pane may be bonded together by 100% silicone sealant and be adequately reinforced by frames. In one configuration, the height of the first section 102 is 8' to 12'.

While the first section 102 of the diving pool 100 is illustrated by way of example as being substantially transparent, in other embodiments, the walls may not be see through but, instead, have windows on one or more platforms 110, 111, for viewing the activity in the dive pool 100. For example, viewers in a dining setting, students in a classroom setting, researcher in a laboratory setting, or caregivers in a medical setting are able to view the activities in the dive pool 100. The top platform 106 in the first section 102 is above water level. It is appropriately configured to allow divers convenient ingress and egress from the dive pool 100. In one example, there is a ledge at 4' depth from the top of the diving pool and 6' (or more) in width, thereby providing sufficient room for easy ingress and egress from the dive pool 100. Platform levels 108 and 110 of section 102 are below the water level and can be transparent and/or include one or more windows in one or more embodiments.

Although the first and second sections 102, 104 of the diving pool 100 are depicted as circular, the first and/or second sections 102, 104 may be of other shapes such as octagonal, oval, rectangular, etc. The second section 102 may be made of opaque material such as vinyl, fiberglass, tile, concrete, and other suitable material. In an exemplary embodiment, transparent/windowed sections may be introduced at different tiers of the second section 104 as well (e.g., window 137) to allow viewing of the activity in the dive pool 100.

Although FIG. 1 illustrates that section 102 includes one platform 106 above or at the water level, exemplary embodiments can have more or less platforms above or at the water level. The platforms can be below or above the ground level, such that some or all of the platforms are above ground level, or all of the platforms are below ground level. Further, some of all of the tiers can be above ground level, or all of the tiers can be below ground level.

Figures 2A, 2B, 2C:
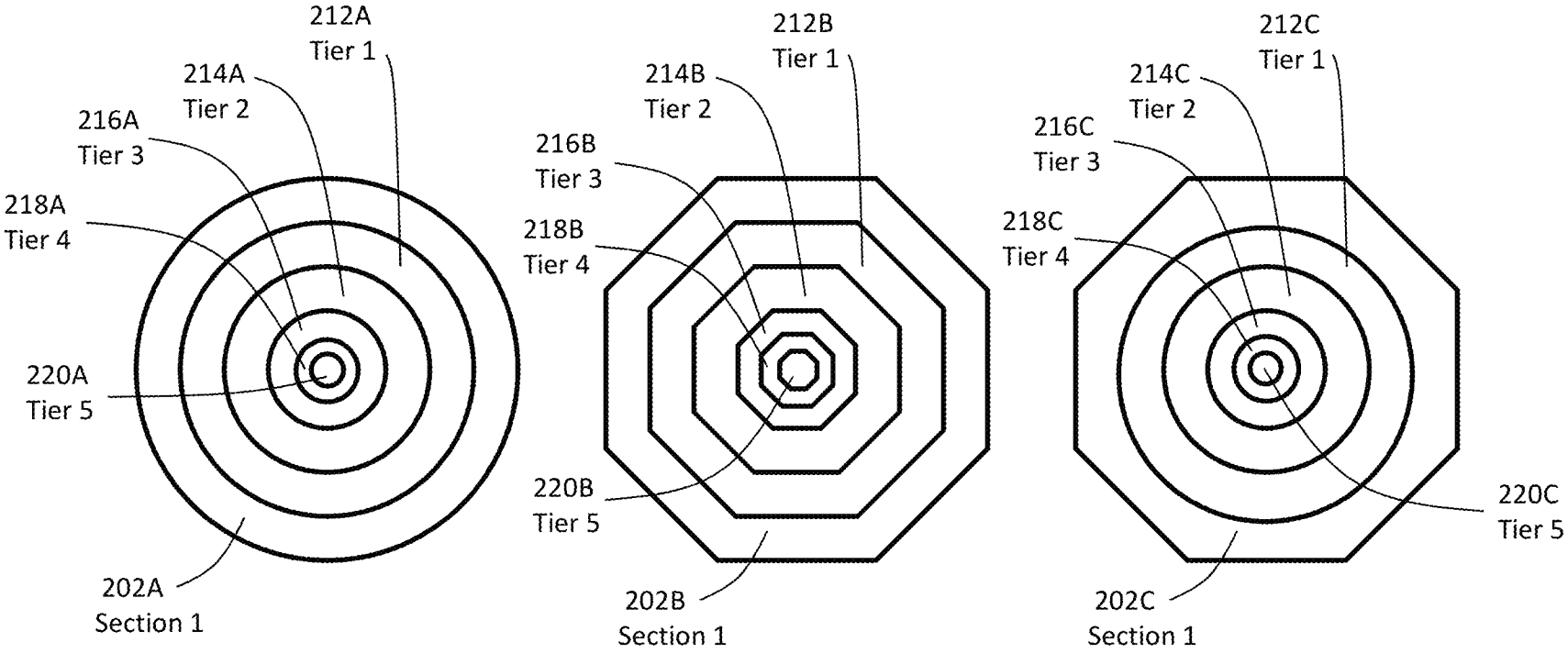
FIGS. 2A to 2C illustrate plan views of diving pools according to exemplary embodiments of the present disclosure.

Reference now is made to FIGS. 2A to 2C, which provide different plan views of exemplary dive pools. FIG. 2A illustrates an exemplary dive pool that has a first section 202A and a second section including a plurality of tiers (e.g., tiers 1 to 5, 212A to 220A, respectively). The second section becomes progressively deeper toward the center of the pool. In an exemplary embodiment, the tiers 1-5 have depths of, for example (but not limited to), 33 feet, 66 feet, 99 feet, 130 feet, and 150 feet, respectively. The depths are not limited to these example depths and can be other depth values as would be understood by one of ordinary skill in the relevant arts. In the exemplary embodiment of FIG. 2A, both section 1 and section 2 have a substantially circular shape.

FIG. 2B is similar in concept to the embodiment of FIG. 2A except that both the first section 202B and the second section comprise a plurality of flat surfaces that are connected together (e.g., hexagonal, octagonal, etc.). Flat panels for both the first section and the second section may reduce the construction cost of the pool and provide an undistorted view through the see-through portions.

FIG. 2C illustrates an exemplary dive pool where the first section 202C includes a plurality of flat surfaces (e.g., resulting in an orthogonal shape) while the second section includes a plurality of tiers (e.g., 212C to 220C) that are each round shape similar to FIG. 2A. Thus, the first section 202C, which is see-through, may be constructed from flat panels (e.g., panes), which may be cheaper than a single continuous curved structure. The second section may be opaque and the shape of each tier (when viewed from the top of the pool) may be circular, oval, or any other desired shape. Put differently, the second section may have a shape that is different from that of the first section because the shape of the second section may not be driven by cost considerations.

Figure 3A:
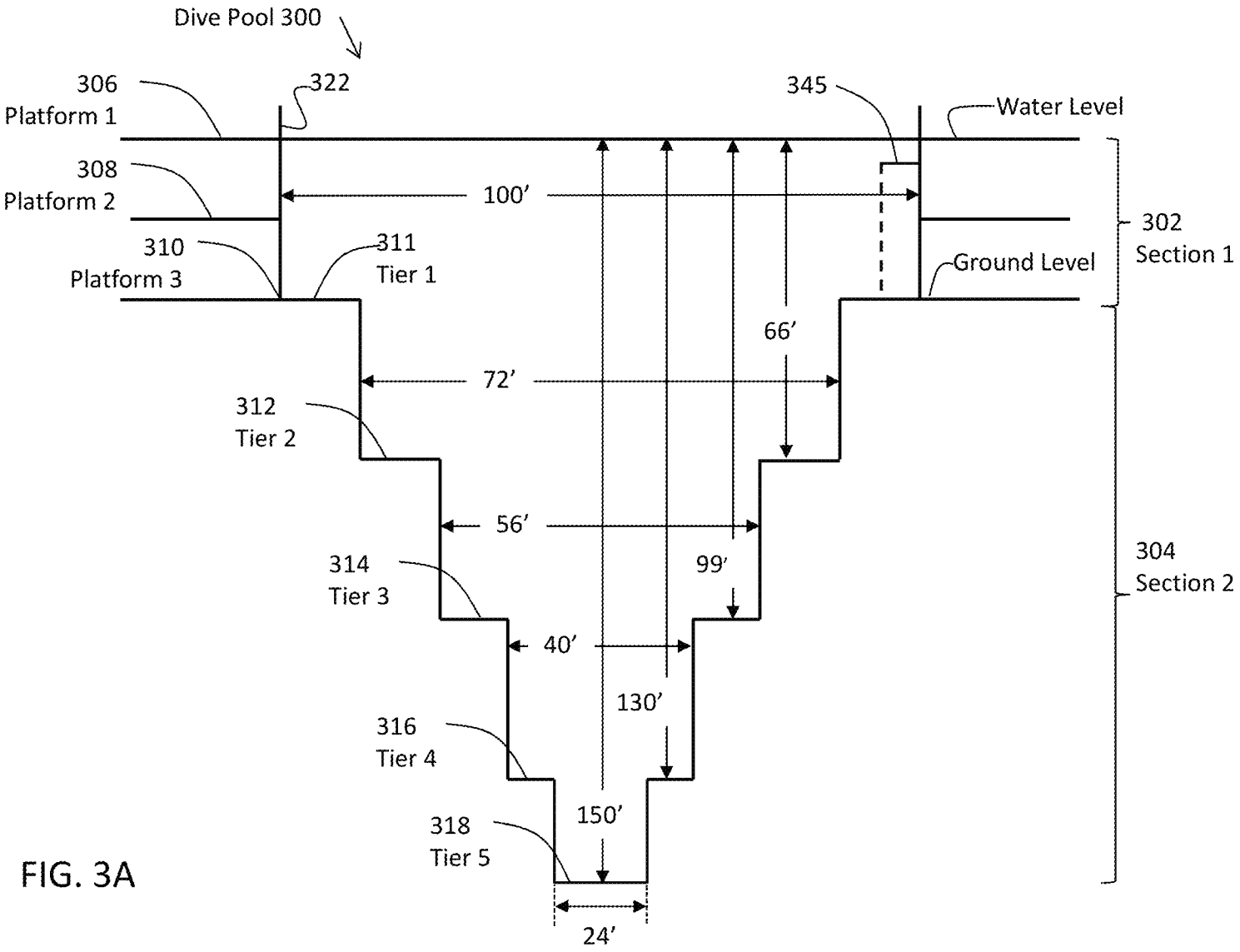
FIG. 3A illustrates a sectional view of a diving pool according to an exemplary embodiment of the present disclosure.

Reference now is made to FIG. 3A, which illustrates different tiers of a diving pool 300 consistent with an exemplary embodiment. Dive pool 300 comprises a first section 302 and a second section 304. The first section 302 of the pool 300 includes several platforms (e.g., 306 to 310). The first platform 306 may be separated from the water by a fence 322. The second and third platforms 308 and 310 are separated from the water inside the pool 300 by a see-through material, as discussed above. As will be understood by one of ordinary skill in the art, the exemplary dimensions and depths illustrated in FIG. 3A are provided for discussion purposes, and the pool 300 is not limited to these exemplary dimensions and depths. For example, the various ledges (e.g. 312, 314, 316) can be 10 feet instead of the illustrated 8 feet. Similarly, the present disclosure is not to be limited to the dimensions and depths provided in the various embodiments.

The top platform 306 is at water level (e.g., half a foot or more from the water surface). Thus, an observer standing at the top platform 306 is able to view the activity in the pool 300 by looking down into the water. In an exemplary embodiment, immediately below the top platform is the second platform 308 that is below water level. The second platform 308 may be used as another observation deck. In the exemplary embodiment of FIG. 3A, the third platform 310 is the last platform of the first section 302. The third platform 302 extends inside the pool to provide a first terrace in the pool (i.e., first tier 311). The terrace is stable platform that provides a floor to one or more divers at that tier. For example, a diver may stop on such surface to conduct research or simply to adjust their diving gear. In an exemplary embodiment, the first tier is at a depth of, for example, 33 feet, but is not limited thereto.

The second section 304 of the diving pool 300 includes a plurality of tiers (e.g., tiers 2 to 5, (312 to 318)) and becomes progressively deeper toward the center of the pool. In an exemplary embodiment, the maximum depth is 150' from the surface of the dive pool 306. Each tier provides a terrace for a diver. While FIG. 3A illustrates each terrace to be approximately 16 feet in width by way of example, it will be understood that each terrace may be any suitable width, such as 6 feet to 20 feet. Similarly, a depth of 66 feet for the second tier 312, a depth of 99 feet for the third tier 314, a depth of 130' for the fourth tier 316, and a maximum depth of 150 feet for the fifth tier 318 are provided by a way of (non-limiting) example only. The number of tiers and the corresponding depths and other dimensions are not limited to these examples and the number of tiers and their corresponding depths and dimensions can have other values as would be understood by one of ordinary skill in the art. That is, although the embodiments illustrate a pool with a maximum depth of 150 feet, the maximum depth is not limited thereto and the pool can have a different depth as would be understood by one of ordinary skill in the relevant arts. The terrace gradations at 33 feet, 66 feet, 99 feet, and 130 feet are based on the fact that pressure increases by one atmosphere for each 33 feet in depth. Each terrace provides a researcher, dive trainer, therapist, etc., a stable platform to conduct research, but also the opportunity to stop their descent in a safe and controlled way.

In an exemplary embodiment, the diving pool 300 can include a ledge or platform 345. The ledge/platform 345 can be below the surface of the water but close enough to the surface so that diver(s) can stand partially out of the water (e.g. while preparing for the dive). The vertical portion of the ledge/platform 345 is shown in dashed line to represent embodiments that include a structural ledge 345 (e.g. similar to the tier structure). In other embodiments, a horizontal platform 345 can be used that extends towards the center of the pool. In an exemplary embodiment, the ledge/platform 345 is formed only around a portion of the pool. However, in other aspects, it can be formed completely around the pool. The ledge/platform 345 can extend outward (towards the center of the pool) and be, for example, 4 feet long, but is not limited thereto.

In an exemplary embodiment, the height/depth of the terraced pool of FIG. 3A is modular (i.e., reconfigurable) in that one or more of the tiers may be sealed/closed from the one or more tier(s) below. For example, the maximum depth of the modular pool may be substantially reduced by enclosing off the first tier 311 from the tiers 312, 314, 316, and 318 below. Thus, the resulting maximum depth would be 33 feet. The configurable depth can be adjusted based on, for example, the current program (e.g., treatment program) that will be utilizing the pool, the necessary depth needed for the current pool activity, the skill of current users of the pool, etc.

Figure 3B:
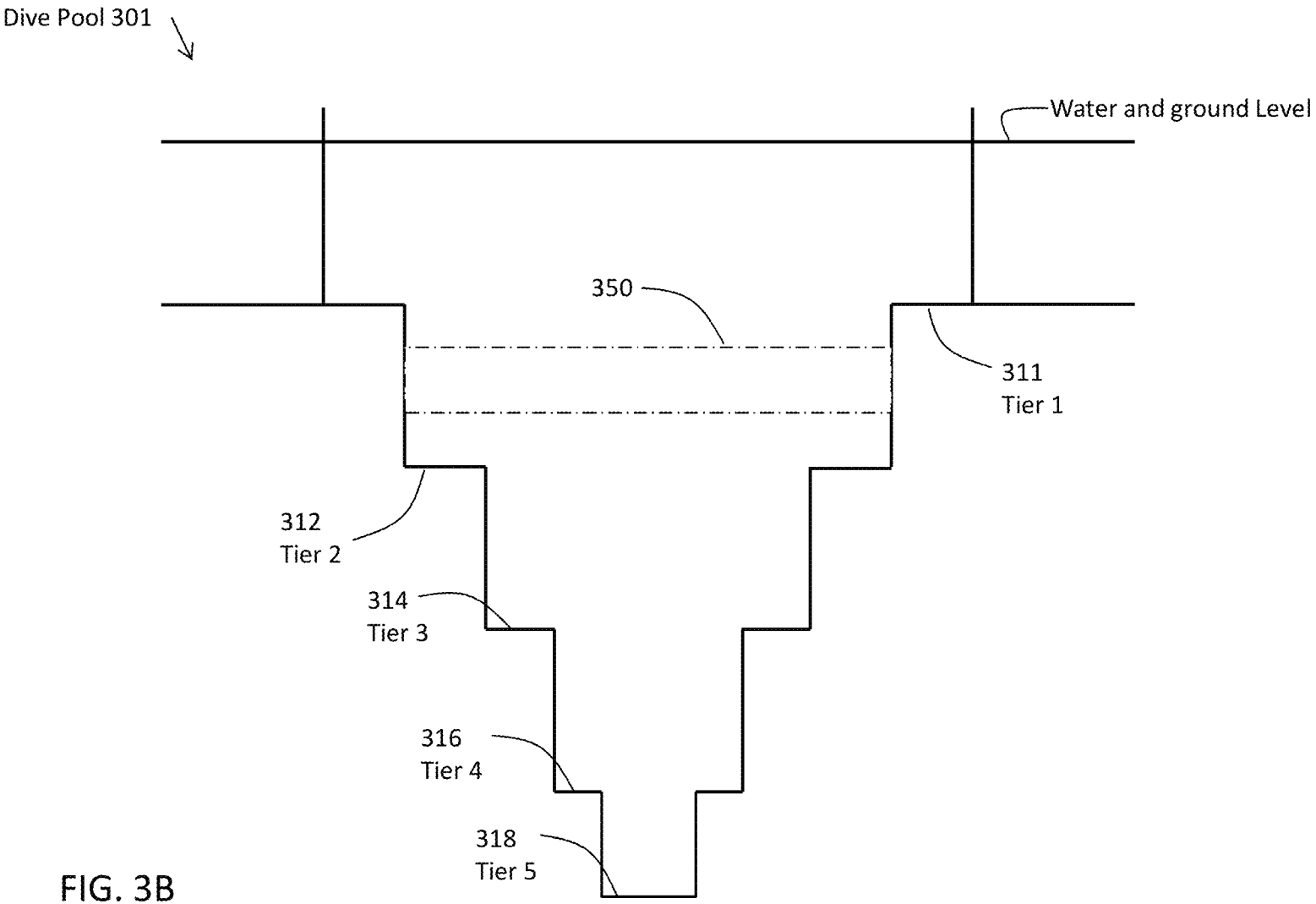
FIG. 3B illustrates a sectional view of a diving pool according to an exemplary embodiment of the present disclosure.

With reference to FIG. 3B, a diving pool 301 is described. The diving pool 301 is similar to the diving pool 300, but includes a walkway 350 extending across the width/diameter of the pool. The walkway 350 is an enclosed path allowing an observer within the walkway to view the activity in the pool 301. In an exemplary embodiment, the walkway 350 is formed by a cylindrical tube that includes at least one or more transparent portions and/or includes one or more widows and/or portals allowing viewing access to the pool from the interior of the walkway 350. In this example, the walkway 350 provides observers an underwater view of the pool from within the dimensions of the pools. Although the walkway 350 is shown to extend across the diving pool 301 between tiers 1 and 2 (311, 312), the walkway 350 can be provided at any depth. Further, the pool 301 can include two or more walkways in one or more embodiments. Although FIG. 3B shows the walkway 350 extending completely across the diameter/width of the pool, the walkway may partially extend into the pool 301 in one or more embodiments. Although not shown in the other figures, the other embodiments of the disclosure can include one or more walkways 350 as would be appreciated by one of ordinary skill in the art.

Figure 4:
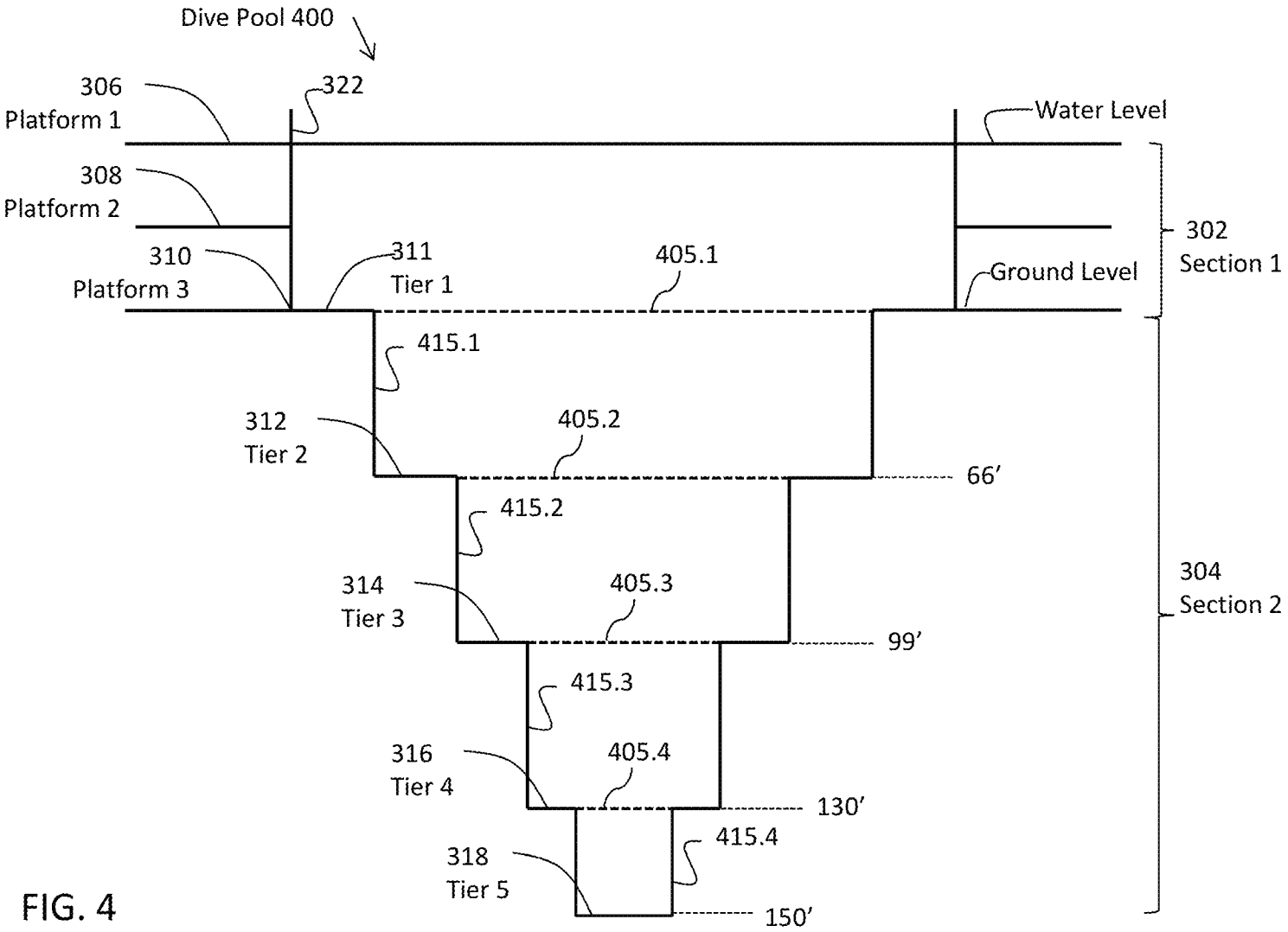
FIG. 4 illustrates a sectional view of a diving pool including one or more covers according to an exemplary embodiment of the present disclosure.

In an exemplary embodiment, with reference to FIG. 4, one or more tiers can be closed off with a cover or platform 405. The cover 405 can be configured to be releasably fastened to the wall 415 of the respective tier to close off the tier(s) below. Although the cover is shown connected to the wall at the top of the respective tier, the cover can be connected at any depth between two adjacent tiers in other aspects. The cover 405 can be manually or automatically connected/disconnect from the surrounding walls 415 at the respective tier using one or more fasteners, such as one or more releasable hook and loop mechanism, one or more zippers, one or more magnets (e.g., an electromagnetic that can be selectively activated to fasten the cover 405), or one or more other fasteners as would be understood by one of ordinary skill in the art.

In an exemplary embodiment, the cover 405 can be weighted and/or neutrally buoyant so as to facilitate the placement of the cover 405 at the corresponding tier under water. In an exemplary embodiment, the cover 405 can be configured to have an adjustable buoyancy to facilitate placement of the cover 405. For example, the cover 405 can have a neutral or negative buoyancy for when the cover 405 is placed and/or mounted in the pool. The buoyancy can then be adjusted to a positive buoyancy (e.g., add air to a buoyancy chamber) so that the cover 405 floats to the surface of the pool to facilitate removal of the cover 405. In an exemplary embodiment, the cover 405 may be placed at the corresponding tier from the surface of the pool 400. For example, the cover 405 may be include cables or rope along the perimeter of the cover 405 which are feed through respective pulleys located along the tier perimeter. The cabling or rope can then be feed to the surface of the pool 400. To deploy the cover 405, the cabling/rope can be pulled from the surface to pull the cover down to the corresponding tier.

Figure 5:
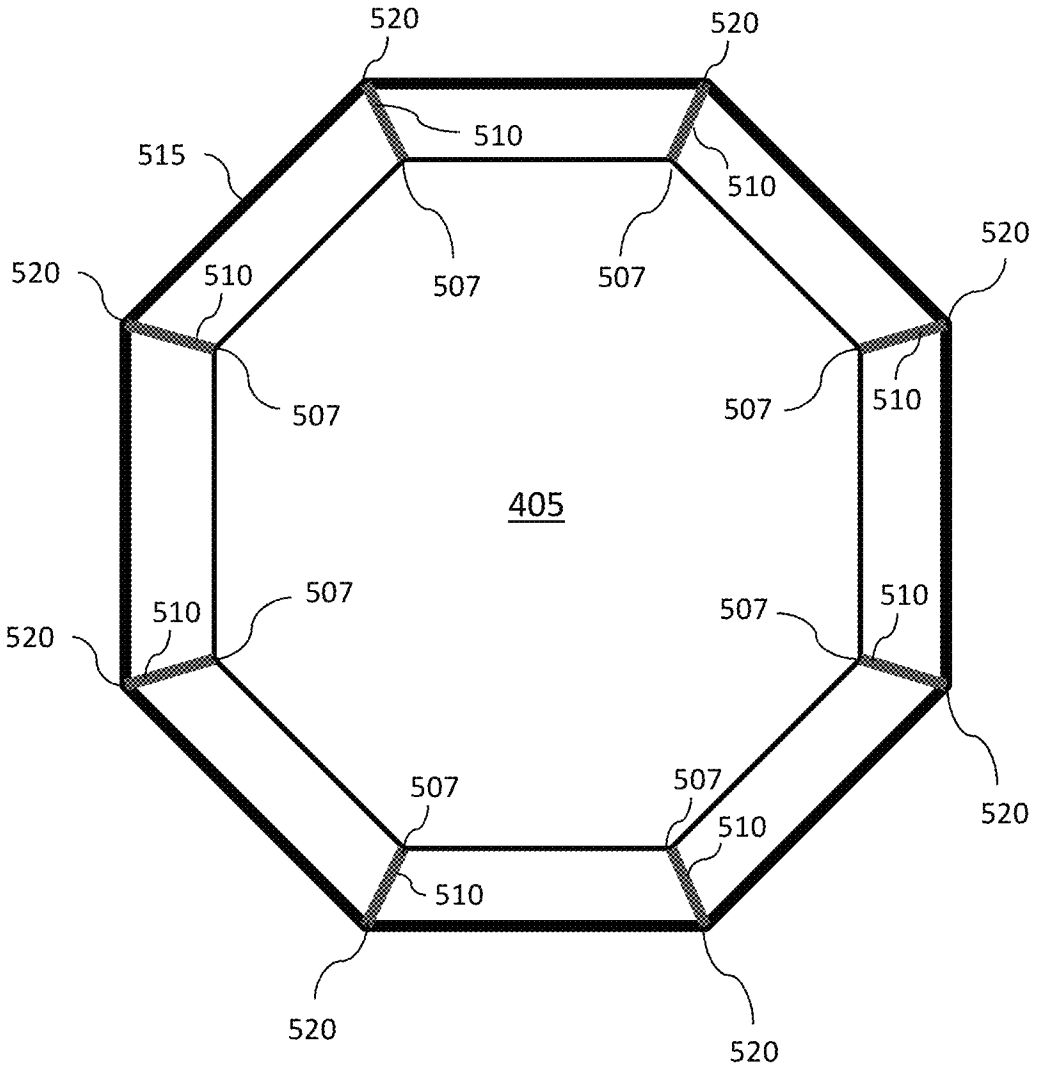
FIG. 5 illustrates a plan view of a diving pool tier including a cover according to an exemplary embodiment of the present disclosure.

In an exemplary embodiment, with reference to FIG. 5, the cover 405 includes one or more connection points 507 that can be connected to a corresponding connection point 520 at the wall 515 via a connector or fastener 510. In an exemplary embodiment, the connections can be configured with an emergency release mechanism so that the cover 405 can be disconnected in an emergency situation, for example. Additionally or alternatively, the cover 405 can include a section of the cover 405 (e.g., a door) that can be opened in an emergency to allow a person to pass through the cover 405.

In an exemplary embodiment, the connection via the connection 510 can require a tool or key to releasably connect the cover 405 to the connection point 520. Therefore, the cover 405 can be securely locked in a connected state and cannot be released without the required key or tool.

In exemplary embodiment, the connection points 520 can be electromagnets that are configured to magnetically connect to the connectors 510. In this example, the connection points 520 can be configured as electromagnetic connections that can be activated/deactivated to releasably connect to the connectors 510. Further, the electromagnetic connection points 520 can be remotely controlled between the active and deactivated states. In operation, the cover 405 can be moved into position and magnetically connected to the active electromagnetic connection points 520. To remove the cover, the electromagnetic connection points 520 can be deactivated to release the cover. In an embodiment, the cover 405 can be slightly buoyant so that when released, the cover 405 floats to the surface of the pool 400. In exemplary embodiment, the pool 405 can include one or more control panels near one or more connection points 520 and/or one or more control panels outside of the pool 400 to control the connection of the cover 405. The interior and/or exterior control panels can also include an emergency release control that will allow the cover 405 to be released in emergency situations.

In an exemplary embodiment, the cover 405 may be made of a taut, durable, and water permeable material (e.g., fabric, including natural and/or synthetic fiber materials) that is stretched to the periphery of the respective tier. Advantageously, the water permeability of the cover allows water to circulate through the entire pool, thereby not disturbing the water filtration system. The cover 405 can be a net in one or more embodiments. The cover 405 can be flexible, semi-rigid, or rigid in one or more exemplary embodiments. In an exemplary embodiment the filtering system of the pool uses ozone or saline to substantially reduce the degradation of the material (e.g., nylon) of the cover 405.

In various embodiments, the cover 405 may be substantially or fully rigid and connectable to the wall (e.g., wall 415, 515) of the pool via coiled springs or other elastic connectors to provide a "trampoline" like response under water. Thus the elasticity is provided by the springs or other biasing members that connect to the rigid cover 405 to store and then release energy. Alternatively or additionally, the cover 405 may be elastic itself. In example where the cover 405 is alternatively elastic, the cover 405 may still provide a "trampoline" like effect even in cases where the connectors (e.g., 510) are not elastic. In an exemplary embodiment, the cover 405 can be at the same level (i.e., height) as the top of the respective tier that it is isolating and begins where the terrace ends. For example, the cover 405.2 can extend towards the center of the pool 400 from the edge of the top surface of the tier 312.

In an exemplary embodiment, the cover 405 can have substantially the same diameter as the tier below. It will be appreciated that the spaces between the cover 405 and the wall 515 in FIG. 5 have been exaggerated for ease of illustration, and the cover 405 can be closer to (or farther away from) the adjacent wall 515.

In an exemplary embodiment, the cover 405 does not need to be placed at the end of a tier as shown in FIG. 4, and the cover 405 can be placed at any depth level within a particular tier. For example, the cover 405.1 may be configured to be placed at a depth of 20 feet for safety, while the first tier has a maximum depth of 33 feet. When a tier is enclosed by the cover 405, divers are prevented from reaching the greater depths of the pool. Accordingly, the height of the pool is modular in that each tier is configured to be enclosed with respect to the tier below. Thus, a diver may be prevented from reaching a depth that may not be deemed to be safe for him or her.

In an exemplary embodiment, the cover 405 may be configured as an automatically deployable cover. For example, the cover 405 can be configured as a retractable iris mechanism (e.g., similar to an iris of an aperture of a camera) that retracts into corresponding cavities within the walls 415, 515 of the corresponding tier.

Figure 6A:
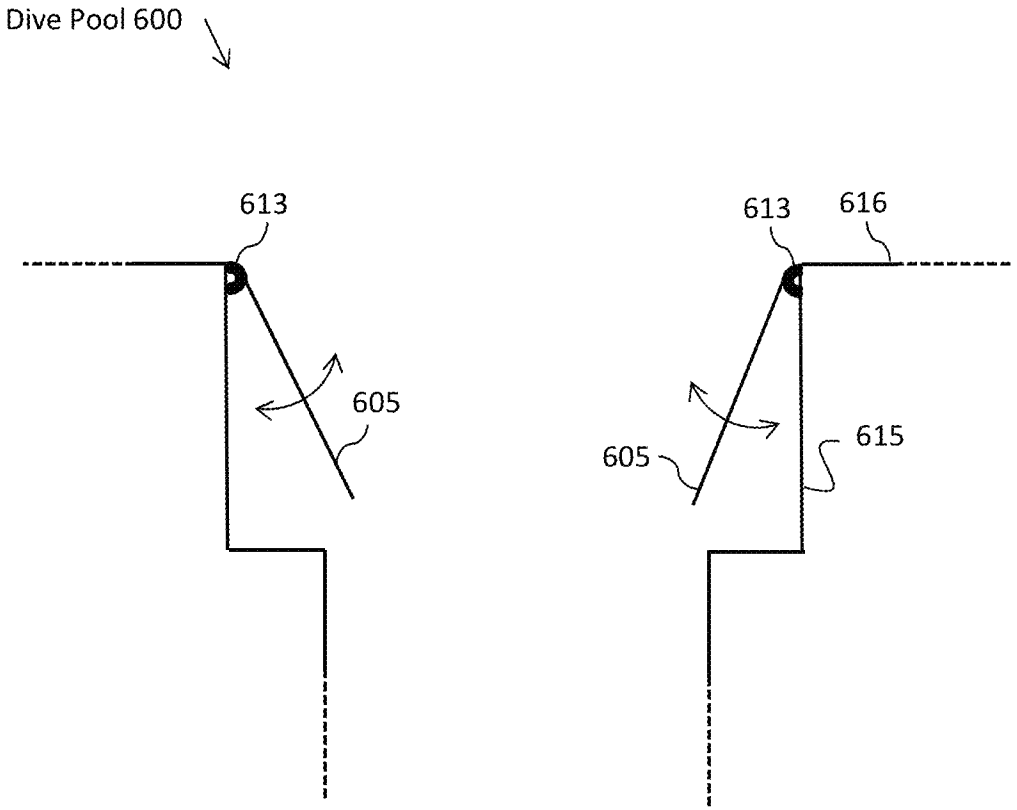
FIG. 6A illustrates a sectional view of a diving pool tier including cover segments connected to corresponding wall sections of the pool according to an exemplary embodiment of the present disclosure.
Figure 6B:
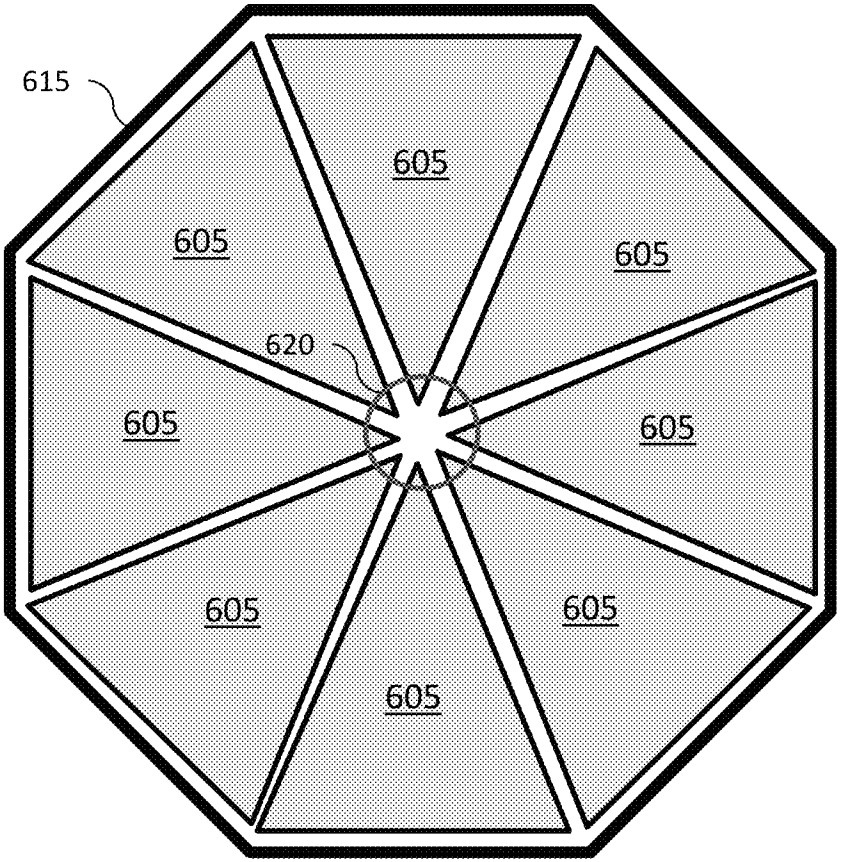
FIG. 6B illustrates a plan view of the diving pool tier of FIG. 6A.

In an exemplary embodiment, with reference to FIG. 6A, the cover 605 can be formed of two or more segments 605 that are retractably mounted to a corresponding wall 615. For example, each of the segments 605 can be rotatably connected to the wall 615 via a rotatable connection 613, such as a hinge. In one or more embodiments, the rotatable connection 613 includes one or more biasing members (e.g., springs, weights, buoyance devices) that are configured to bias the corresponding segment 605 into position. For example, the segment 605 can be biased into a closed (non-deployed) position (e.g., vertical position) against a corresponding wall section 615 or into a deployed position (e.g., as shown in FIG. 6B) where the segment 605 is substantially parallel (e.g., horizontal) to the ledge 616. In an exemplary embodiment, the segments 605 can be biased into a closed position when at an angle less than, for example, 45 degrees with respect to the corresponding wall section 615 and biased into a deployed position when at an angle greater than or equal to, for example, 45 degrees. In an exemplary embodiment, the wall sections 615 can include a recessed portion to house the corresponding cover segments 605 while in the closed position (e.g., flush with the surface of the wall 615) so that the cover segments 605 do not obstruct the users of the pool when deployed.

In an exemplary embodiment, the deployed segments 605 can be secured (e.g., locked) into the deployed position. For example, the rotatable connection 613 can be configured to selectively lock the corresponding segment 605 into a particular position. Alternatively or additionally, the segments 605 of the cover can be locked together with a connection 620 as shown in FIG. 6B. In an exemplary embodiment, the segments 605 can be locked while in a closed position to ensure that the segments 605 remain in the closed position.

Figure 6C:
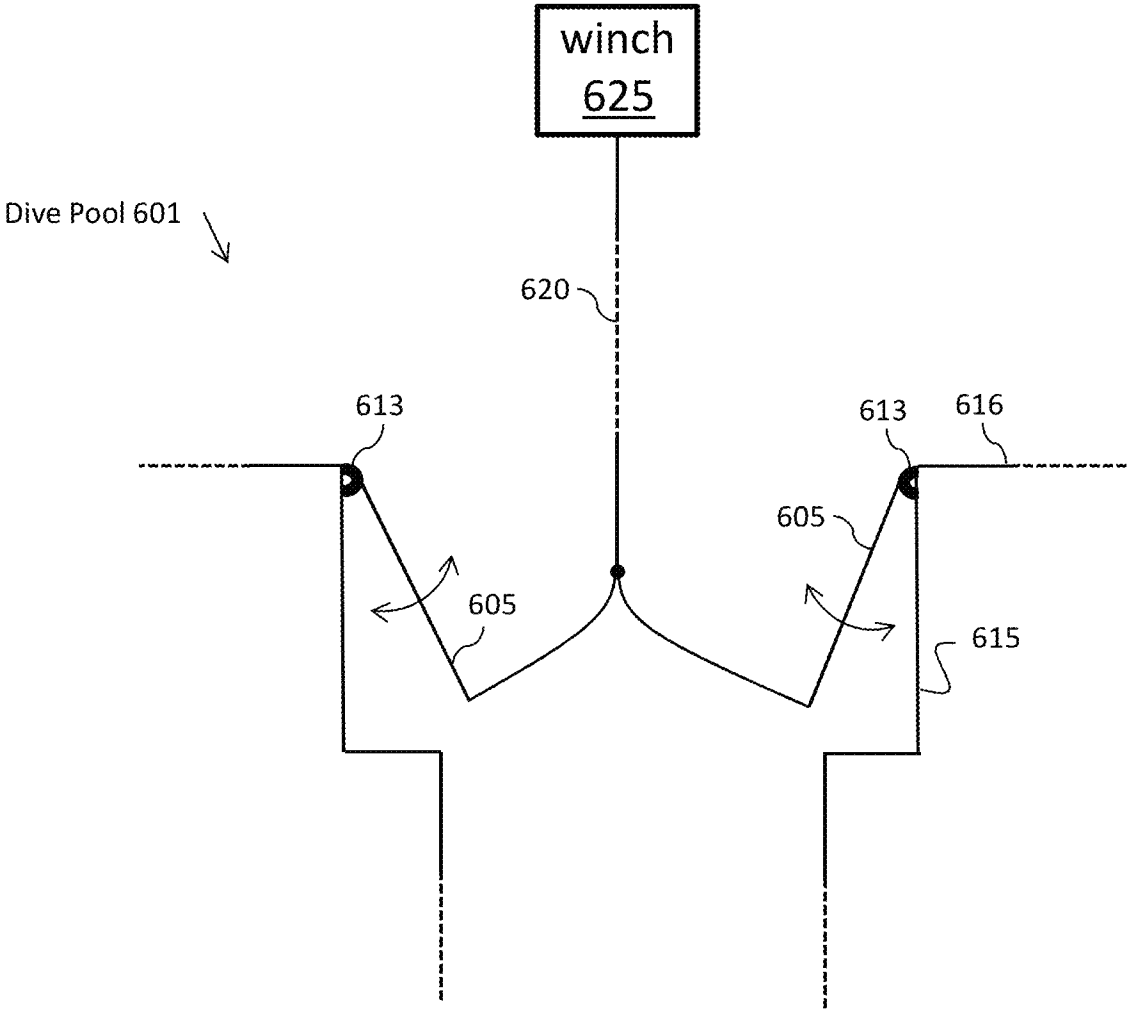
FIG. 6C illustrates a sectional view of a diving pool tier including cover segments connected to corresponding wall sections of the pool and a winch system according to an exemplary embodiment of the present disclosure.

Turning to FIG. 6C, a diving pool 601 is shown, which is similar to diving pool 600, but includes a winch 625 that is configured to adjust the position of the segments 605. The winch 625 can be a manual winch and/or powered (e.g. motorized) winch. The winch 625 can be controlled by a controller that includes one or more circuits, logic, and/or processors.

In an exemplary embodiment, the winch 625 is connected to some or all of the segments 605 (e.g. each segment 605) via one or more cables 620. In operation, the winch 625 can draw the cable 620 into the winch 625 (e.g. wind the cable 620) to raise the segments 605 into the deployed position (e.g., horizontal position). Similarly, the winch 625 can release the cable 620 (e.g. unwind, add slack to the cable 620) to allow the segments 605 to lower into the non-deployed (open) position (e.g., vertical position) against a corresponding wall section 615. In this example, the segments 605 can be biased into the non-deployed (open) position by one or more biasing members (e.g. springs, weights, etc.). As shown, the winch 625 is located above the diving pool 601 (and above the water surface) and the cable 620 extends down into the water to engage the segments 605. In this example, the cable 620 can function as an assent and descent line extending from the surface of the water to the segments 605. The line can be used by divers to ascend/descend within the water. The position of the winch 625 is not limited. For example, the winch 625 can be located above the water surface but on a side of the pool. In this example, the winch 625 can include a davit system (e.g. arm) to extend the cable 620 out towards the center of the pool.

In another embodiment, the winch 625 can be positioned below the segments 605. In this example, the winch 625 is configured to draw in the cable 620 to move the segments 605 from the deployed (closed) position to the non-deployed (open) position. In this example, the segments 605 can be biased into the deployed (closed) position by one or more biasing members (e.g. springs, buoyance devices, etc.).

In an exemplary embodiment, one or more of the wall segments 605 can be remotely operated between the closed and deployed positions. For example, the rotatable connections 613 can include a motor or other mechanism (e.g., actuator) that is configured to move the corresponding wall segment 605 between the various positions. In another example, the wall segments 605 can include a corresponding piston (e.g., pneumatic or hydraulic) that is connected between the wall section 615 and the corresponding segment 605 that moves the segment 605 into position. The position of the segments 605 can be controlled by a controller that includes one or more circuits, logic, and/or processors.

In an exemplary embodiment, blind divers and/or visually impaired are able to independently make their way around the pool by following a braille trail. To that end, the sides of the pool include tactile protrusions that may provide information and/or guidance to blind or visually impaired divers. The braille trail may be attached to the side walls and the floor (e.g., terrace) of the pool at one or more tiers (e.g., 310 to 316) to provide directional signs that would indicate to the diver which path to follow.

In addition to the tactile directional signs, additional tactile items may be included in the trail to provide additional stimulation to the diver. For example, artificial sea fans, brain coral, soft corals, etc., may be included to be touched and "seen" by the visually impaired diver. The artificial objects may be temporarily attached to the walls and floors of the pool by various fastening methods, including suction, latches, tying, etc. In an exemplary embodiment, the artificial objects may also be fastened to the cover. Thus, the pool may be configured to provide a safe environment that is still challenging and adventurous to the visually impaired.

In an exemplary embodiment, there are stairs and/or ramps with grab rails to each tier (e.g., 310, 312, 314, and 316). In this regard, individuals in wheel chairs may use ramps to descend to a lower tier and easily maneuver back up. In an exemplary embodiment, the grade of the ramp is 6% to 12%.

In an exemplary embodiment, underwater cameras are placed at one or more tiers (e.g., 310, 312, 314, and 316) in the pool. For example, every tier without window access (e.g., second section 304) may include underwater lighting and a system of cameras. The images from the cameras may be viewed from a remote lab and/or displays at platforms 306, 308, and 310 in a restaurant, classroom, etc., setting.

Conclusion

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "an exemplary embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

What is claimed is:

1. A diving pool, comprising:

a first tiered section extending to a first depth of the diving pool;

a second tiered section extending to a second depth of the diving pool that is deeper than the first depth; and a cover configured to be releasably positioned within the diving pool at a depth of the diving pool to isolate a shallower portion of the diving pool above the cover from a deeper portion of the diving pool below the cover, wherein:

the cover comprises two or more segments that are each configured to be independently and selectively moveable between a non-deployed position and a deployed position; and the two or more segments are configured to collectively form a barrier between the shallower portion and the deeper portion, to isolate the shallower portion from the deeper portion, when the two or more segments are in the deployed position.

2. The diving pool of claim 1, wherein the cover is configured to releasably connect to at least one point on a side of the diving pool at the depth using one or more connectors to isolate the first tiered section from the second tiered section.

3. The diving pool of claim 2, wherein the cover is releasably connected to the side of the diving pool using hook-and-loop mechanism, a zipper, or a magnetic connector.

4. The diving pool of claim 2, wherein the one or more connectors include a locking mechanism requiring a key unique to the locking mechanism to restrict release of a connection of the cover to the side of the diving pool.

5. The diving pool of claim 1, wherein the cover is water permeable.

6. The diving pool of claim 1, wherein the second tiered section has a smaller width or diameter than a width or diameter of the first tiered section.

7. The diving pool of claim 6, further comprising:

a third tiered section extending from the second depth to a third depth of the diving pool that is deeper than the second depth, the third tiered section having a width or diameter that is less than that of the second tiered section; and a fourth tiered section extending from the third depth to a fourth depth of the diving pool that is deeper than the third depth, the fourth tiered section having a width or diameter that is less than that of the third tiered section.

8. The diving pool of claim 1, wherein the first tiered section is above ground level and the second tiered section is below ground level.

9. The diving pool of claim 1, wherein both the first tiered section and the second tiered section are above or below ground level.

10. The diving pool of claim 1, further comprising a third tiered section and a fourth tiered section, wherein:

the first depth is 33 feet from a water level;

the second depth is 66 feet from the water level;

the third tiered section extends to a depth of 99 feet from the water level; and the fourth tiered section extends to a depth of 130 feet from the water level.

11. The diving pool of claim 10, wherein:

the first tiered section has a width or diameter of 100 feet or less;

the second tiered section has a width or diameter of 72 feet or less;

the third tiered section has a diameter or width of 56 feet or less; and the fourth tiered section has a diameter or width of 40 feet or less.

12. The diving pool of claim 1, wherein the cover has a neutral buoyancy to facilitate placement of the cover at the depth.

13. The diving pool of claim 1, wherein the cover is configured to have an adjustable buoyancy to facilitate deployment of the cover at the depth and/or facilitate removal of the cover from the depth.

14. The diving pool of claim 1, wherein the cover includes a buoyancy element having a selectable buoyancy to select a buoyancy of the cover to facilitate movement of at least one of the two or more segments of the cover between the non-deployed position and the deployed position.

15. The diving pool of claim 14, wherein the selectable buoyancy of the buoyancy element is:

adjustable to a negative or neutral buoyancy to facilitate movement of the at least one of the two or more segments of the cover to the non-deployed position, and adjustable to a positive buoyancy to facilitate movement of the at least one of the two or more segments of the cover to the deployed position.

16. A diving pool, comprising:

a first tiered section extending to a first depth of the diving pool configured to provide a pressure of two atmospheres to facilitate pressure-based therapeutic treatment at the first depth;

a second tiered section extending to a second depth of the diving pool that is deeper than the first depth to provide a pressure of three atmospheres to facilitate pressure-based therapeutic treatment at the second depth; and a cover configured to be releasably positioned within the diving pool at a depth of the diving pool to isolate a shallower portion of the diving pool above the cover from a deeper portion of the diving pool below the cover.

17. The diving pool of claim 16, further comprising a third tiered section extending from the second depth to a third depth of the diving pool that is deeper than the second depth and that is configured to provide a pressure of four atmospheres to facilitate pressure-based therapeutic treatment at the third depth.

18. The diving pool of claim 17, further comprising a fourth tiered section extending from the third depth to a fourth depth of the diving pool that is deeper than the third depth and that is configured to provide a pressure of five atmospheres to facilitate pressure-based therapeutic treatment at the fourth depth.

19. The diving pool of claim 16, wherein the depth at which the cover is positioned is selectable based on an identified treatment program to provide a platform at a corresponding pressure to facilitate pressure-based therapeutic treatment using the corresponding pressure.

* * * * *